US006425381B1

(12) United States Patent
Rammer

(10) Patent No.: US 6,425,381 B1
(45) Date of Patent: Jul. 30, 2002

(54) METHOD FOR RECYCLING EXHAUST GAS OF A MULTI-CYLINDER RECIPROCATING INTERNAL COMBUSTION ENGINE OPERATED WITH A TURBOCHARGER

(75) Inventor: Franz Rammer, Wolfern (AT)

(73) Assignee: MAN Steyr AG (AT)

( * ) Notice: Subject to any disclaimer, the term of this patent is extended or adjusted under 35 U.S.C. 154(b) by 0 days.

(21) Appl. No.: 09/632,704

(22) Filed: Aug. 4, 2000

(30) Foreign Application Priority Data

Aug. 4, 1999 (AT) ..... 1339/99

(51) Int. Cl.[7] ..... F02M 25/07

(52) U.S. Cl. ..... 123/568.12; 123/58.8; 60/605.2

(58) Field of Search ..... 123/58.8, 568.11, 123/568.12, 568.13; 60/605.2

(56) References Cited

U.S. PATENT DOCUMENTS 4,131,095 A * 12/1978 Ouchi ..... 123/58.8
5,121,734 A 6/1992 Grieshaber et al.
5,517,976 A * 5/1996 Bachle et al. ..... 123/568.12
5,711,154 A * 1/1998 Baechle et al. ..... 60/605.2
6,009,709 A * 1/2000 Bailey ..... 123/568.12
6,138,650 A * 10/2000 Bailey ..... 123/568.12
6,220,233 B1 * 4/2001 Pierpont ..... 123/568.12

FOREIGN PATENT DOCUMENTS

DE 4331509 C1 9/1993
EP 0442981 B1 9/1993

* cited by examiner

*Primary Examiner*—Willis R. Wolfe
(74) *Attorney, Agent, or Firm*—R W Becker & Associates; R W Becker

(57) ABSTRACT

A method of recycling exhaust gas of a multi-cylinder reciprocating internal combustion engine with an exhaust turbocharger operates without EGR flutter valves and also reduces the amount of designed complexity for the entire EGR design. Exhaust gas recycling is only permitted in the system during certain phases of operation of the internal combustion engine. Only the exhaust gas expelled from one cylinder of a cylinder row is completely or partially recycled at a preset exhaust gas recycling rate via the exhaust gas recycling duct to the blowing air manifold duct, while such exhaust gas recycling is prevented between such exhaust gas recycling phases of operation. The exhaust gas expelled from the cylinder or cylinders is also fed to the exhaust gas turbocharger via the gas manifold duct.

6 Claims, 5 Drawing Sheets

Figure 1:
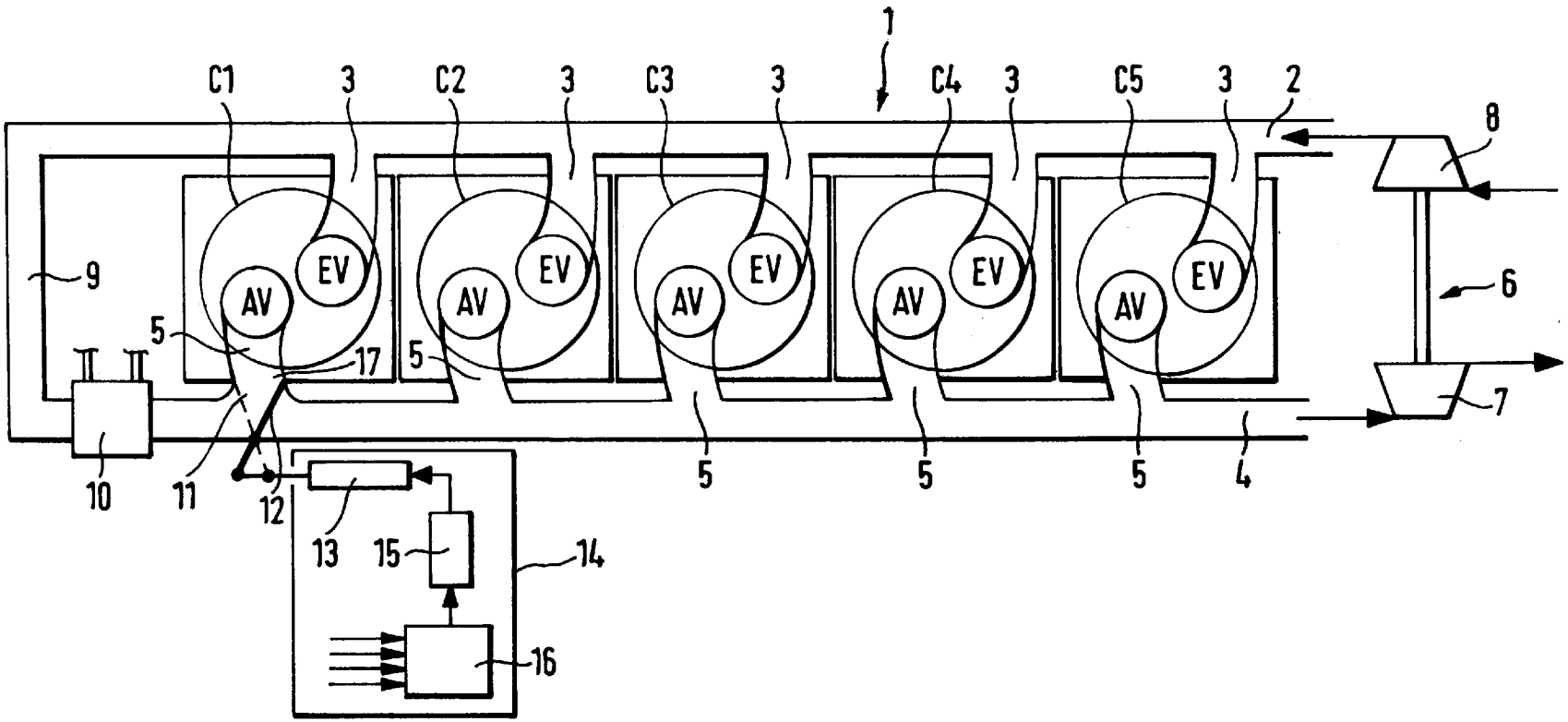

METHOD FOR RECYCLING EXHAUST GAS OF A MULTI-CYLINDER RECIPROCATING INTERNAL COMBUSTION ENGINE OPERATED WITH A TURBOCHARGER

BACKGROUND OF THE INVENTION

The invention relates to a method for recycling exhaust gas of a multi-cylinder reciprocating internal combustion engine operated with an exhaust gas turbocharger, which for each cylinder possesses at least one inlet valve in an inlet duct connected with a blowing air manifold and at least one outlet valve in an outlet duct connected with an exhaust gas manifold and furthermore an exhaust gas recycling duct between the exhaust gas manifold and the blowing air manifold.

THE PRIOR ART

The invention is concerned with the following problem. It is prior art to reduce NOx emission of internal combustion engines by returning their exhaust gas to the induction side. In this case the exhaust gas is taken from an exhaust duct and returned to the induction system of the respective internal combustion engine. For optimum efficiency it is furthermore necessary to cool the recycled exhaust gas. However in the case of blown internal combustion engines and more particularly those with cooling of the blowing air to prevent fouling up the compressor and the blowing air cooler by residues of the exhaust gas, the exhaust gas is preferably tapped upstream from the turine, cooled and returned to the induction system at some point downstream from the blowing air cooler. In the characteristics of an internal combustion engine there are however many ranges, in which the mean exhaust gas counter pressure upstream from the turbine is greater than the mean blowing pressure downstream from the blowing air cooler. This means that in this operational range there will be, in the absence of special measures, a flow of the blowing air into the exhaust gas duct and not, as desired, of the exhaust gas into the induction system. Various measures are known for preventing the establishment of a flow in the wrong direction and also to ensure that an amount of exhaust gas, which is sufficient as regards the desired reduction of emission of NOx, may flow against the existing pressure gradient back to the starting point. One known means for this is the use of special-purpose check valves, so-called EGR flutter valves, in the exhaust gas recycling duct. In this case advantage is taken of pressure peaks occurring in the exhaust gas duct in order to open the EGR flutter valve and to cause the exhaust gas to flow to the induction side. When the pressure in the exhaust gas duct drops below the pressure of the blowing air, the EGR flutter valve, which is now closed, will prevent this resulting in a reversal of the direction of flow. This exhaust gas recycling by means of EGR flutter valves does however have certain disadvantages. The greater the efficiency of the turbocharger, the greater the mean pressure difference between the blowing air pressure and the counter pressure of the exhaust gas and the smaller the exhaust gas recycling rate, which can be attained. This means that improvements in fuel consumption obtainable by optimum designs of the turbocharger can not be attained, because then no optimized exhaust gas recycling rates can be produced. Furthermore, EGR flutter valves are subject to a high thermal load due to the recycled exhaust gas, this entailing an extremely high expenditure on design in order to be sure of getting the necessarily long service life and reliability for such EGR flutter valves. A disadvantage is furthermore that following disintegration of an EGR flutter valve, which are necessarily lacking in robustness, under the high dynamic loading, fragments of the valves will be induced by the internal combustion engine, something which then constitutes a substantial risk of damage to the engine. Besides the relatively high costs of development, the relatively expensive and complex manufacture of such EGR flutter valves is to be noted as a further disadvantage. A further disadvantage is that the exhaust gas must be cooled upstream from any flutter valve in order to not impair its service life, for which reason for each exhaust gas path with its separate exhaust gas recycling duct, its own EGR cooler, flutter valve, a shut off member is required upstream from the turbine in order to attain the desired exhaust gas recycling rates.

To round off the prior art attention is also to be paid to the MTZ Motortechnische Zeitschrift 60 (1999) 4 pages 240, 242. In section 3.3 there is a mention of a donor cylinder principle. This involves the employment of a cylinder solely for exhaust gas recycling and returning the exhaust gas ejected from this cylinder via an exhaust gas return duct with an EGR cooler directly to the blowing air manifold duct. This design is misdirected for a number or reasons and is furthermore not in accordance with practical requirements either.

SHORT SUMMARY OF THE INVENTION

One object of the invention is hence to provide a method for exhaust gas recycling for an internal combustion engine of the type initially mentioned, which may be performed using simple means and deals with the problems which have so far occurred in connection with EGR flutter valves. As regards designs, which deal with the above mentioned disadvantages and problems, it is to be borne in mind that the exhaust gas recycling means must be able to be turned off, for example when using the engine as a brake and however also when accelerating from low revs, it is absolutely necessary, for the sake of keeping down particle emission, to prevent exhaust gas from getting into the induction system. It is consequently necessary to take measures to see that return flow of the exhaust gas, for instance while using the engine as a brake, that exhaust gas return flow is reliably prevented.

In accordance with the characterizing part of claim 1 this object is to be achieved because recycling of exhaust gas is only permitted during certain operational phases of the internal combustion engine and during such exhaust gas recycling phases only the exhaust gas, which is ejected from one cylinder of a row of cylinders, is completely or partially recycled at a setting of the exhaust gas recycling rate via the exhaust gas return duct to the blowing air manifold duct, this exhaust gas return or recycling being however prevented outside i. e. between such exhaust gas recycling phases and the exhaust gas ejected from the cylinder or cylinders, just like the exhaust gas from the other cylinders, being completely recycled to the exhaust gas turbocharger via the exhaust gas manifold duct.

Advantageous embodiments and details of the design in accordance with the invention are recited in the dependent claims.

One principle of the method in accordance with the invention is that in the exhaust gas return or recycling phases the expulsion work of the piston of a cylinder of a row of cylinders of the internal combustion engine is directly employed for the recycling of exhaust gas. The method of the invention therefore entirely makes do without the so far required, expensive and sensitive and furthermore unreliable EGR flutter valves. Dependent on whether the exhaust gas outlet of the reciprocating internal combustion engine has one or two valves and how many cylinders the internal combustion engine has, it is merely necessary to provide at least one control member, which is under the control of a control device, with which during exhaust gas recycling phases only the exhaust gas expelled from one cylinder of a row of cylinders is returned completely or partially at a set exhaust gas recycling rate via the exhaust gas recycling duct to the induction system. In certain cases it is possible, in the simplest conceivable manner, to employ a design with one control member, which is only to be set in the positions EGR-on or EGR-off. In other cases, in which the control member may also be shifted into intermediate positions for the purpose of setting the recycling rate, the range of regulation may be so large that an exhaust gas recycling rate will be set which is optimized in accordance with requirement and is exactly adapted to the respective load state of the internal combustion engine.

In what follows the invention will be described in more detail with reference to the drawings, in which various types of multi-cylinder reciprocating internal combustion engines will be seen together with examples of details with which the method of the invention may be performed.

LIST OF THE SEVERAL VIEWS OF THE FIGURES

FIG. 1 diagrammatically shows a reciprocating internal combustion engine having five cylinders arranged in a row, each cylinder having one inlet valve and one outlet valve, together with a device for the performance of the exhaust gas recycling method of the invention.

Figure 2:
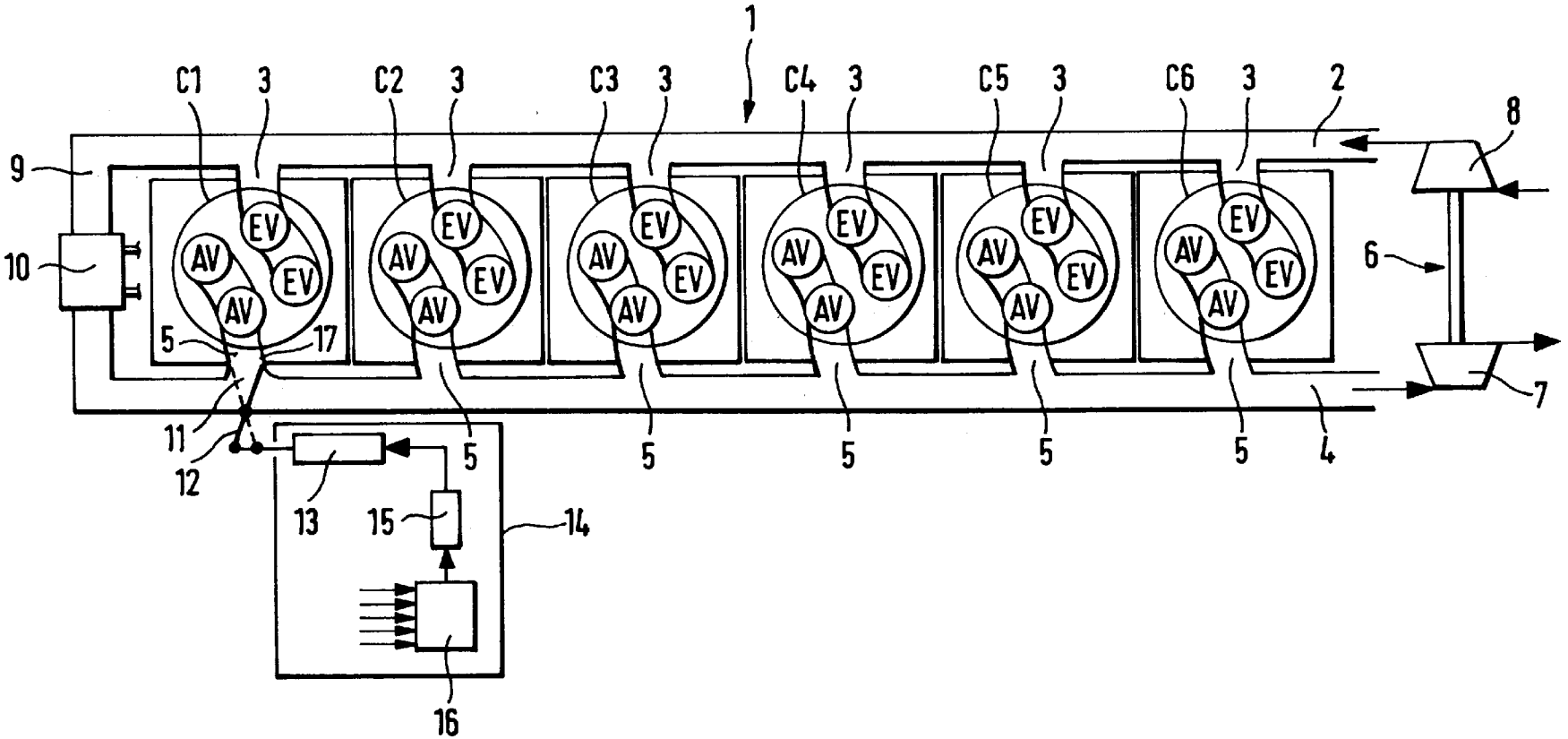

FIG. 2 diagrammatically illustrates a reciprocating internal combustion engine having six cylinders arranged in a row, each cylinder having two inlet valves in a common inlet duct and two outlet valves in a common outlet duct, together with a device for the performance of the method of the invention.

Figure 3:
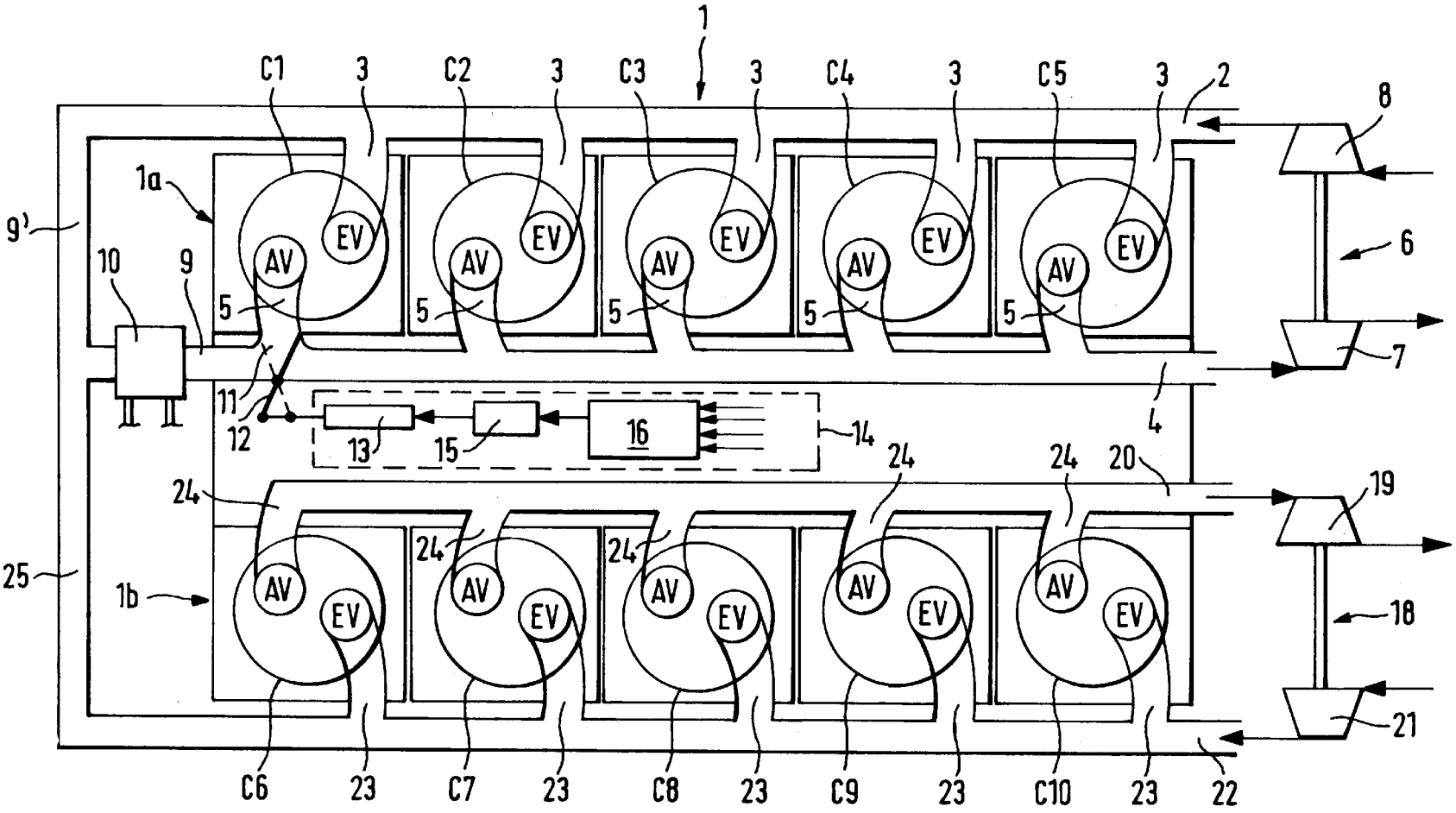

FIG. 3 diagrammatically depicts a reciprocating internal combustion engine having two rows of cylinders arranged in a V each having five cylinders, each cylinder having one inlet valve and one outlet valve, together with a device for the performance of the exhaust gas recycling method of the invention.

Figure 4:
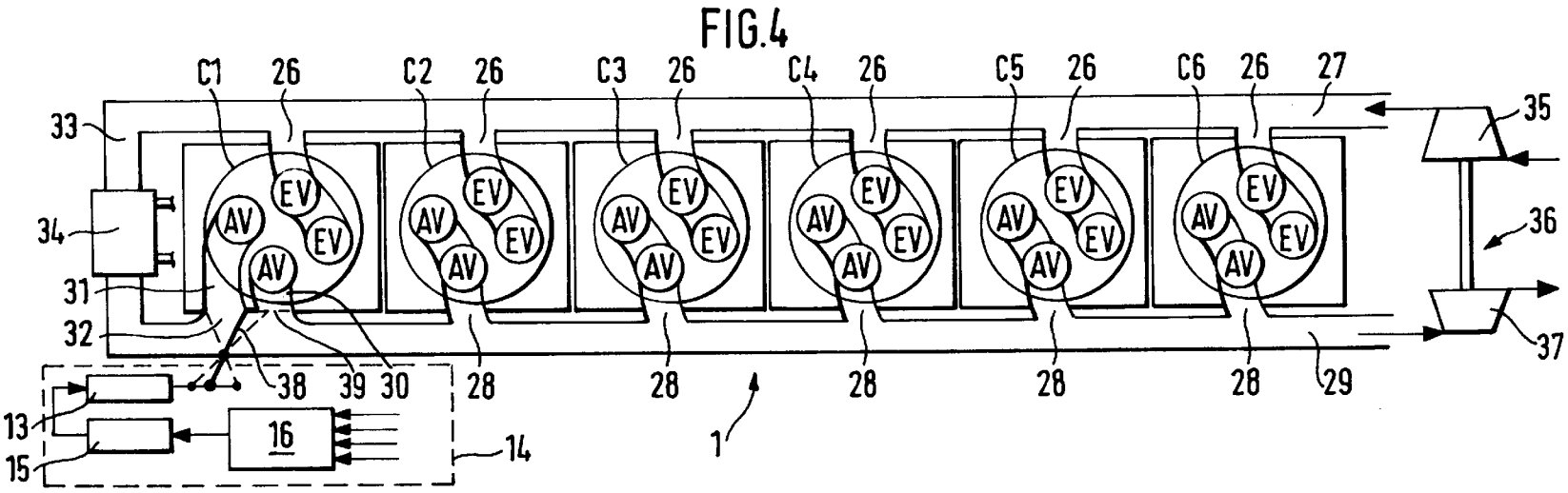

FIG. 4 diagrammatically shows a reciprocating internal combustion engine having six cylinders arranged in a row, each cylinder having two inlet valves and two outlet valves, together with a device for the performance of the method of the invention.

Figure 5:
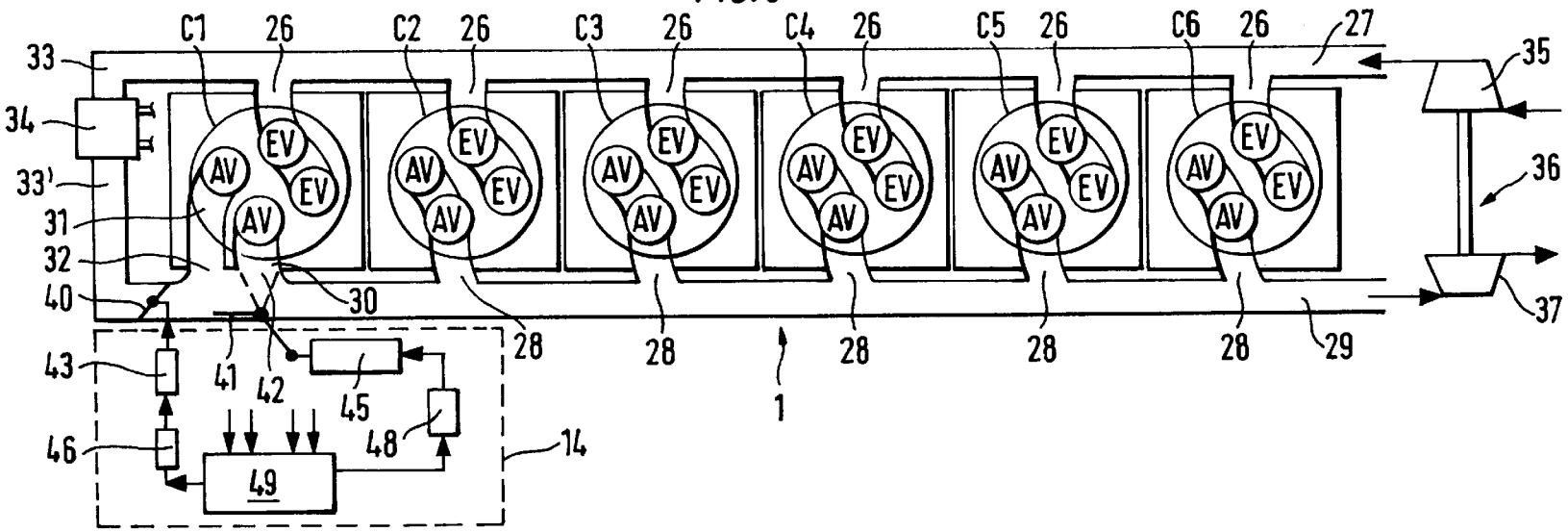

FIG. 5 shows a further six cylinder reciprocating internal combustion engine with in-line cylinders with two inlet valves and two outlet valves per cylinder, but with a device, which is somewhat different to that of FIG. 4, for the performance of the exhaust gas recycling method in accordance with the invention.

Figure 6:
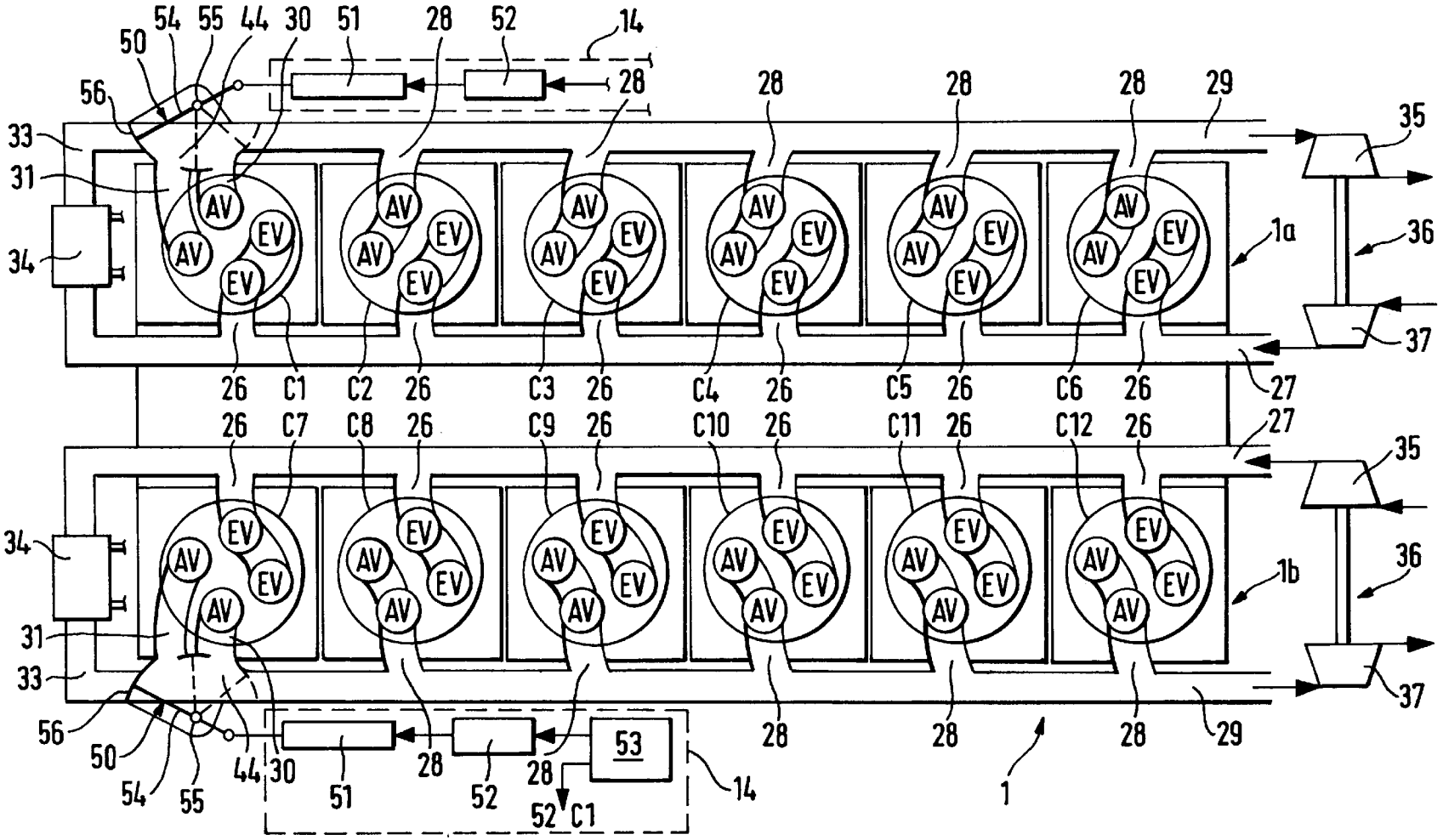

FIG. 6 diagrammatically illustrates a reciprocating internal combustion engine comprising two rows of cylinders arranged in a V each having six cylinders, there being two outlet valves and two inlet valves per cylinder and for each cylinder row a device for performing the exhaust gas recycling method of the invention.

LIST OF THE SEVERAL VIEWS OF THE FIGURES

In the figures of the drawing identical or functionally equivalent parts are provided with the same reference numerals for the sake of clarity.

In FIG. 1 the individual cylinders of the five cylinder reciprocating internal combustion engine 1 are referenced C1, C2, C3, C4 and C5. Each of these cylinders possesses an inlet valve EV arranged at the end of an inlet duct 3, which is connected with a blowing air manifold duct 2 and is arranged in the cylinder head, and furthermore an outlet valve AV arranged at the start of an outlet duct 4, which is connected with an exhaust gas manifold duct 5 and is arranged in the cylinder head. An exhaust gas turbocharger is referenced 6. Its exhaust gas turbocharger is connected with the exhaust gas manifold duct 4 and its compressor supplies air preferably via a blowing air cooler, not illustrated, to the blowing air manifold duct 2. Reference numeral 9 indicates an exhaust gas recycling duct, which produces a continuous connection between the exhaust gas manifold duct 4 and the blowing air manifold duct 2 and in which only one EGR cooler 10 for cooling recycled exhaust gas is installed. Unlike this internal combustion engine in accordance with FIG. 1 the engine of FIG. 2 possesses two inlet valves EV in a common inlet duct 3 and two outlet valves AV in a common outlet duct 5. Furthermore, the internal combustion engine of FIG. 2 is a six cylinder engine.

The two internal combustion engines of FIGS. 1 and 2 share the feature that the cylinder C1 is selected as that cylinder whose exhaust gas is recycled during certain phases of operation. In this respect at a suitably designed transition zone 11 downstream from the associated outlet duct 5 on the one hand the exhaust gas manifold pipe 4 and on the other hand the exhaust gas recycling duct 9 (for discharge therefrom) is connected and furthermore a control flap valve 12 is pivoted. This control flap valve 12 serves in this example both as a control member, with which exhaust gas recycling is possible and the exhaust gas recycling rate may be set, and also as a shut off valve member, with which exhaust gas recycling may be prevented. The actuation of the control flap valve 12 is performed with the aid of a hydraulic, pneumatic or electric servo-motor 13 as part of a control means 14 with a motor driver part 15 and electronic circuitry 16. The latter comprises a microprocessor and a storage means for data and programs containing the control program together with operational data and data of characteristics, which are related to the type of the reciprocating internal combustion engine 1 and furthermore the regulation and control algorithm and the points in time, so as to predetermine the times at which, how and in which the phases of operation of the internal combustion engine 1 the exhaust gas recycling is to take place or to be prevented at given adjustable exhaust gas recycling rates. In this case by means of the servo-motor 13 under the control of the electronic circuitry 16 via the motor driving part 15 the control flap valve 12 is able to be shifted a) into a first terminal position, in which exhaust gas flow from the outlet duct 5 of the cylinder C1 to the exhaust gas recycling duct 9 is shut off but is permitted to the exhaust gas manifold duct 4 so that therefore no exhaust gas recycling is possible, and furthermore during exhaust gas recycling phases of operation, b) in partial loading of the engine 1 into the other terminal setting, in which entry of exhaust gas from the outlet duct 5 of the cylinder C1 to the exhaust gas recycling duct 9 is completely enabled but is prevented to the exhaust gas manifold duct 4 or, respectively, to the exhaust gas turbocharger 6, c) for full load operation of the internal combustion engine 1 in intermediate positions between the two terminal positions, into which the exhaust gas leaving the outlet duct 5 is divided up into a flow part supplied to the exhaust gas recycling duct 9 and recycled to the blowing air manifold duct 2 and a flow part entering the exhaust manifold duct 4 passed to the exhaust gas turbocharger 6 so that there is an exhaust gas recycling rate which is smaller than in operation with under a partial load.

Owing to there being five cylinders in the case of FIG. 1 accordingly in partial load operation of the internal combustion engine 1 an exhaust gas recycling rate of 20% would be possible at the most. In the case of FIG. 2 with six cylinders there would be a maximum exhaust gas recycling rate of around 16%. Both recycling rates are however too high at certain points of operation of the internal combustion engine 1, for example under full load and are therefore correspondingly reduced by the effect, mentioned in part c), on the quantity of exhaust gas expelled from the cylinder C1, to, for example, a value of ≦12%. A choke means 17 serves to enhance these effects on the quantity of exhaust gas. Setting and pre-setting the control flap valve 12 is performed in discrete increments or continuously using the control means 14. In the case of a wide range of regulation it is because of this possible to set the exhaust gas recycling rate to suit the respective load state of the internal combustion engine 1 in accordance with needs.

In FIG. 3 the cylinders of the one row 1A of the 10 cylinder reciprocating internal combustion engine 1 are referenced as C1, C2, C3, C4 and C5 whereas the cylinders of the other row 1*b* are referenced C6, C7, C8, C9 and C10. As regards the blowing air manifold duct 2, the inlet ducts 3, the inlet valves EV, the outlet valves AV, the exhaust gas turbocharger 6 with the exhaust gas turbine 7 and the compressor 11, the control flap valve 12 and the control means 14 with the servo-motor 13, the motor driving part 15 and the electronic circuitry 16, such parts for the cylinder row 1*a* are the same as those of the internal combustion engine of FIG. 1. Only there is no choke means 17 and furthermore the control flap valve 12 is only able to be set in the one terminal position "EGR on" or the other terminal position "EGR off". In this case no adjustment of the exhaust gas recycle rate is provided for here and is furthermore not necessary. For the second cylinder row 1*b* an exhaust gas turbocharger 18 is also provided, which normally is identical in design to the one (6) employed in the first cylinder row and whose exhaust gas turbine 19 is connected with an exhaust gas manifold duct 20 and whose compressor 21 is connected with a blowing air manifold duct 22. At the end of an inlet duct 23 connected with the blowing air manifold duct 22 each cylinder C6, C7, C8, C9 and C10 of the second cylinder row 1*b* also possesses an inlet valve EV arranged in the cylinder head and at the start of each outlet duct 24 connected with the exhaust gas manifold duct 20 possesses an outlet valve AV arranged in the cylinder head. Via an exhaust gas recycling duct 25, which extends from the exhaust gas recycling duct 9, the blowing air manifold duct 22 is connected to the section 9' (which extends between the EGR cooler 10 and the blowing air manifold duct 9) of the exhaust gas recycling duct 9. In exhaust gas recycling operation the blowing air manifold duct 22 is consequently supplied, like the blowing air recycling duct 2, with exhaust gas expelled from the cylinder C1 and introduced into the exhaust gas recycling duct 9. The exhaust gas recycle rate may in this case amount to 10% of the overall amount exhaust gas at the maximum. The switching over of the control flap valve 12 operation without exhaust gas recycling operation to operation with exhaust gas recycling is implemented by suitable commands of the control means 14. In order to ensure that this takes place it may be appropriate to see that both cylinder rows 1*a* and 1*b* are supplied with the same quantity of recycled exhaust gas by providing rate of flow control valves in the exhaust gas recycling duct 25 and the exhaust gas recycling duct section 9', such control valves being able to be controlled by the control means 14, like the control flap valve 12. In some cases such rate of flow control valves may be also arranged to function as shut off valves in order to ensure a certain degree of redundancy and to guard against the possibility of control by the control flap valve 12 failing such that said flap valve is not able to be shifted partly or completely into its position shutting down the exhaust gas recycling duct 9.

Alternatively to the design depicted in FIG. 3 in the case of a V arrangement of the cylinder rows 1*a* and 1*b* with respectively five or more cylinders it would also be feasible to design each of the two rows of cylinders as in the case in accordance with FIG. 1 or FIG. 2. In this case a control flap valve 12 and furthermore a choke means 20 would be provided for the outlet duct 24 of the cylinder C6, and furthermore the exhaust gas recycling duct 25 would be connected with the exhaust gas manifold duct 20 and the latter would be connected by means of its own EGR cooler. The control flap valve 12 of the second cylinder row 1*b* would also be provided with a servo-motor 13 and furthermore a motor driver part 15 and common electronic circuitry 16 within the control means 14. Such an arrangement would then permit, in the case of a cylinder row 1*a* and 1*b* of five cylinders, an exhaust gas recycling rate of at the most 20%, which however would be too high in the case of full load operation and must consequently be set at a correspondingly lower value by regulating means—as illustrated in connection with FIGS. 1 and 2—via the two control flap valves 12.

The working examples in accordance with FIGS. 4 through 6 involve reciprocating internal combustion engines 1 having per cylinder C1 to C6 (FIGS. 4 and 5) and, respectively, C1 to C12 (FIG. 5) two inlet valves EV and two outlet valves EV and two outlet valves AV. In this case the two inlet valves EV of each cylinder C1 to C6 and C7 to C12 of each cylinder row 1 and, respectively, 1*a* and 1*b* in the cylinder head are associated with a common inlet duct 26, which branches off from a blowing air manifold duct 27. In the case of the outlet valves AV on the contrary the conditions in the case of one cylinder per cylinder row, preferably of the cylinder C1 (FIGS. 4 and 5) and, respectively, of the cylinders C1 and C7 (FIG. 6) are different to the conditions in the case of the other cylinders. In these other cylinders C2 through C6 (FIGS. 4 and 5) and, respectively, C2 through C6 and C8 through C12 (FIG. 6) in each case their outlet valves AV in the cylinder head are associated with a respective common outlet duct 28, which opens into an exhaust gas manifold duct 29. The part on or, respectively, adjacent to the cylinder C1 (FIGS. 3 and 4) or, respectively, the cylinders C1 and C7 (FIG. 6) is on the contrary differently designed in accordance with the invention. In this case only one of the two outlet valves AV of this cylinder C1 (FIGS. 4 and 5) or, respectively, of these cylinders C1 and C7 (FIG. 6) in the cylinder head is associated with an outlet duct 30, which opens into the exhaust gas manifold duct 29. The respectively other outlet valve AV of this cylinder C1 (FIGS. 4 and 5) or, respectively, these cylinders C1 and C7 (FIG. 6) on the other hand is associated with an outlet duct 31, which in the cylinder head is arranged adjacent to the outlet duct 30 and opens in a transition zone 32 between the exhaust gas manifold duct 29 and an exhaust gas recycling duct 33 extending from same. This exhaust gas recycling duct 33 passes through an EGR cooler 34 and at its other end is connected with the blowing air manifold duct 27. The latter is for its part connected with the compressor 35 of an exhaust gas turbocharger 36, whose exhaust gas turbine 37 is connected with the exhaust gas manifold duct 29.

While there are these points in common in the embodiments of FIGS. 4 through 6 the devices for the control of exhaust gas recycling operation and for influencing the exhaust gas recycling rate are different.

In the case of FIG. 4 as control member there is a control flap valve 38, which is arranged in the transition zone 32 between the outlet duct 31, the exhaust gas recycling duct 33 and the exhaust gas manifold duct 29 (where it is suitably pivoted) and which just like the flap valve (12) of FIGS. 1 and 2 is able to be actuated with the aid of a servo-motor 13 as a part of the control means 14 having the motor driver part 15 and electronic circuitry 16, and may be put in a full load position, a shut off position and any desired intermediate settings. During the exhaust gas recycling phases of the internal combustion engine In this case the exhaust gas expelled from the cylinder C1 by its piston into the outlet ducts 31 and 31, is, a) introduced during partial load operation of the internal combustion engine 1 with the control flap valve 38 in the fully open setting into the exhaust gas recycling duct 33 exclusively and completely and returned to the blowing air manifold duct 27 so that there is a maximum exhaust gas recycling rate of approximately 16%, or b) when approaching full load operation of the internal combustion engine 1 with the control flap valve 38 in the intermediate settings reducing the exhaust gas recycling rate, partly introduced into the exhaust gas manifold duct 29 and partly into the exhaust gas recycling duct 33, the exhaust gas recycling rate then becoming set to a value smaller than the maximum of 16.6%.

If no exhaust gas recycling should be necessary or desired, the control flap valve 38 is moved into the shut setting and the exhaust gas expelled from the cylinder C1 is exclusively and completely introduced into the exhaust gas manifold duct 29 and supplied to the exhaust gas turbocharger 36.

For fine adjustment of the exhaust gas recycling rate in this example a control choke 39 is provided. Same is either installed in the outlet duct 30 or downstream from same at the transition to the exhaust gas manifold duct 29 and either able to be actuated by the control flap valve 38 or, like the control flap valve 38, able to be set and reset by means of the control means 14. Between the exhaust gas recycling phases of the internal combustion engine 1 such control choke 39 is set to its fully open cross section or aperture. During the exhaust gas recycling operation phases on the contrary the aperture of the control choke 39 is set to its maximum or to intermediate settings between maximum and a minimum differing from zero.

Unlike the design in accordance with FIG. 4 in the case of the embodiment in accordance with FIG. 5 there is a shut off member 40 in the section 33' between the EGR cooler 34 and the transition zone 32, of the exhaust gas recycling duct 33 and furthermore a control member 41 pivotally mounted in the transition zone 32. Using such control member 41 the exhaust gas leaving the outlet zone 42 of the outlet duct 30 is allotted to the exhaust gas turbocharger 36 and/or the exhaust gas recycling duct 33. Each of the two members 40 and 41 is able to be actuated in accordance with its function by means of a servo-motor 43 and 45, forming part of the control means 14, with an associated motor driver part 46 and 48, which receives its commands from electronic circuitry 49. The electronic circuitry 49 is as regards its hardware designed like that (16) of the other embodiments and as regards software and furthermore data and stored characteristics is adapted for such application. The control member 41 may assume two terminal settings, namely a shut off setting and an open flow permitting setting (as indicated in full lines). During the exhaust gas recycling operational phases of the internal combustion engine 1, in which the exhaust gas manifold duct 29 is shut off and does not permit flow to the transition zone 32 and, respectively, to the exhaust gas recycling duct 33 through the control member 41 and the exhaust gas recycling duct 33 is open owing to the shut off valve 40, which is set to be fully open, the exhaust gas expelled from the cylinder C1 into the outlet ducts 30 and 31 is exclusively introduced into the exhaust gas recycling duct 33, i. e. flow through to the exhaust gas manifold duct 29 is prevented. This is what occurs in the partial loading condition of the internal combustion engine 1 and the consequence is that the exhaust gas recycling rate reaches its maximum of approximately 16%. When approaching the full load range of the internal combustion engine 1 the control member 41 is moved into such intermediate settings, in which the exhaust gas current leaving the outlet duct 30 is divided into two flow parts, of which the one is recycled via the exhaust gas recycling duct 33 to the blowing air manifold duct 27 and the other one is introduced into the exhaust gas manifold duct 29 and is supplied to the exhaust gas turbocharger 36 so that the exhaust gas recycling rate is then smaller than in partial load conditions. In intervals between the exhaust gas recycling phases of operation of the internal combustion engine 1 the control member 41 is switched into the open setting and the shut off member 40 is shifted into the shut off setting thereof so that all the exhaust gas leaving via the outlet ducts 30 and 31 is introduced into the exhaust gas manifold duct 29 and is supplied to the exhaust gas turbocharger 36.

In the working embodiment of FIG. 6 each of the cylinders C1 and C7 of a cylinder row 1*a* and 1*b* of the 12 cylinder V engine 1 has a control member 50, which is installed in the transition zone 44. Each of these two control members 50 is able to be moved into two shut off settings and various intermediate settings with the aid of a servo-motor 51, which just like a motor driver part 52 and electronic circuitry 53 is a part of the control means 14. Each of these control members 50 comprises a partition 54 extending with a sealing effect between the side walls here and which at one end is pivotally mounted at a bearing means 55 for swinging movement and at the other end bears an arcuately curved control plate 56, whose outline is in accordance with a certain radius around the center of the bearing means 55. The outline of this control plate 56 cooperates with suitably adapted mating surfaces in the transition zone 44, such surfaces being at a position where the exhaust gas recycling duct 33 starts and where the two mutually adjacent exhaust gas ducts 30 and 31 open.

Owing to this design and arrangement of the such control members 50 it is possible for:

a) in the first shut off setting, the respective exhaust gas recycling duct 33 to be shut off, that is to say no exhaust gas recycling is possible, and all the exhaust gas expelled from the cylinders C1 and C7 by the pistons thereof into the two respective exhaust gas ducts 30 and 31 to be introduced into the respective exhaust gas manifold duct 29, while on the other hand during operational phases with exhaust gas recycling, a) in whose second shut off setting, in which the exhaust gas manifold duct 29 is shut off and which occurs during the partial load state of the internal combustion engine 1, all the exhaust gas expelled from the respective cylinder C1 and, respectively, C7 to be introduced into the respective exhaust gas recycling duct 33, that is to say is completely recycled so that accordingly per cylinder row a maximum exhaust gas recycle rate of approximately 16% is established, b) in their positions, which are angularly deflected than in the second shut off setting, in which the outlet aperture of the respective outlet duct 30 is unblocked to a greater or lesser extent, while getting nearer to the full load operation of the internal combustion engine 1 smaller rates of exhaust gas recycling to be set. In this respect it depends on the range of regulation of the control means 14 whether the exhaust gas recycling rate only approximately or actually assumes a value with an optimum adaptation to needs, such value being exactly set to suit the actual operational condition of the internal combustion engine 1.

What is claimed is:

1. A method of recycling exhaust gas of a multi-cylinder reciprocating internal combustion engine operated with an exhaust gas turbocharger, which for each cylinder possesses at least on inlet valve in an inlet duct connected with a blowing air manifold and at least one outlet valve in an outlet duct connected with an exhaust gas manifold and furthermore an exhaust gas recycling duct between the exhaust gas manifold and the blowing air manifold duct, wherein such exhaust gas recycling is only permitted during certain phases of operation of the internal combustion engine and during such exhaust gas recycling phases of operation only the exhaust gas expelled from one cylinder of a row of cylinders is recycled completely or partially at a set exhaust gas recycling rate via the exhaust gas recycling duct to the blowing air manifold duct, whereas outside of such exhaust gas recycling phases such exhaust gas recycling is discontinued and the exhaust gas expelled from the cylinder or cylinders and like the gas from the other cylinders is supplied to the exhaust gas turbocharger via the exhaust gas manifold;

wherein, when the internal combustion engine has eight or more cylinders and an outlet valve or two outlet valves associated with one common outlet duct per cylinder and when exhaust gas from a single cylinder is able to be recycled, switching over between exhaust gas recycling and non-recycling is implemented by a switching member, said switching member arranged in a transition zone between said outlet duct and the exhaust gas manifold duct and is able to be switched over by a control means into either of two set terminal positions, in the case of which:

a) in a first terminal setting of the switching member outside exhaust gas recycling phases, all the exhaust gas expelled from the cylinder into the outlet duct is introduced into the exhaust gas manifold duct and via the exhaust gas manifold duct is fed to the exhaust gas turbocharger, while on the other hand b) in another terminal setting of the switching over member, which occurs during phases of operation with exhaust gas recycling, all the exhaust gas expelled from the cylinder into the outlet duct is fed into the exhaust gas recycling duct and via the exhaust gas recycling duct to the blowing air manifold duct, and simultaneously, a flow of exhaust gas passing from the outlet duct into the exhaust gas manifold duct to the exhaust gas turbocharger is halted, the exhaust gas recycling rate as a percentage being approximately equal to 100 divided by the number of cylinders.

2. A method of recycling exhaust gas of a multi-cylinder reciprocating internal combustion engine operated with an exhaust gas turbocharger, which for each cylinder possesses at least on inlet valve in an inlet duct connected with a blowing air manifold and at least one outlet valve in an outlet duct connected with an exhaust gas manifold and furthermore an exhaust gas recycling duct between the exhaust gas manifold and the blowing air manifold duct, wherein such exhaust gas recycling is only permitted during certain phases of operation of the internal combustion engine and during such exhaust gas recycling phases of operation only the exhaust gas expelled from one cylinder of a row of cylinders is recycled completely or partially at a set exhaust gas recycling rate via the exhaust gas recycling duct to the blowing air manifold duct, whereas outside of such exhaust gas recycling phases such exhaust gas recycling is discontinued and the exhaust gas expelled from the cylinder or cylinders and like the gas from the other cylinders is supplied to the exhaust gas turbocharger via the exhaust gas manifold;

wherein, when the internal combustion engine has two outlet valves per cylinder for each cylinder whose exhaust gas is to be recycled, wherein each of the two outlet valves is provided with a separate outlet duct, wherein one of said separate outlet ducts opens directly into a transition zone between the exhaust gas manifold duct and the exhaust gas recycling duct and in the cylinder head is designed in a manner separate from that of the others adjacent to it, which again opens in the exhaust gas manifold duct, the exhaust gas expelled into the outlet ducts:

a) during phases of exhaust gas recycling by means of a control member able to be actuated by the control device;

b) in its fully opened position during full load operation of the internal combustion engine, is exclusively and completely passed into the exhaust gas recycling duct and is returned to the blowing air manifold duct;

c) in its intermediate settings reducing the exhaust gas recycling rate approaching full load operation of the internal combustion engine is partly fed to the exhaust gas recycling duct and partly to the exhaust gas manifold duct; and d) outside the exhaust gas recycling phases of operation, owing to the control member being shifted into the shut position, is fed completely into the exhaust gas manifold duct and via the same to the exhaust gas turbocharger.

3. A method of recycling exhaust gas of a multi-cylinder reciprocating internal combustion engine operated with an exhaust gas turbocharger, which for each cylinder possesses at least on inlet valve in an inlet duct connected with a blowing air manifold and at least one outlet valve in an outlet duct connected with an exhaust gas manifold and furthermore an exhaust gas recycling duct between the exhaust gas manifold and the blowing air manifold duct, wherein such exhaust gas recycling is only permitted during certain phases of operation of the internal combustion engine and during such exhaust gas recycling phases of operation only the exhaust gas expelled from one cylinder of a row of cylinders is recycled completely or partially at a set exhaust gas recycling rate via the exhaust gas recycling duct to the blowing air manifold duct, whereas outside of such exhaust gas recycling phases such exhaust gas recycling is discontinued and the exhaust gas expelled from the cylinder or cylinders and like the gas from the other cylinders is supplied to the exhaust gas turbocharger via the exhaust gas manifold;

wherein when said internal combustion engine either has a cylinder row with six or less cylinders or two cylinder rows each with six or less cylinders and an outlet valve or two outlet valves associated with a common outlet duct per cylinder, and when the exhaust gas from a single cylinder per cylinder row is able to be recycled, switching over between exhaust gas recycling and non-recycling is implemented by a control member, which is arranged in a transition zone between the outlet duct and is able to set by a control means to two set terminal positions and at least one intermediate one, and in the one terminal position of the control means, which is set between exhaust gas recycling phases of operation, the exhaust gas expelled from one cylinder in a cylinder row into the outlet duct is completely fed to the exhaust gas manifold duct and via said exhaust manifold duct to the exhaust gas turbocharger, while on the other hand during phases of operation with exhaust gas recycling:

a) during partial load operation of the control member, the control means is shifted into another terminal position, in which all the exhaust gas expelled from the one cylinder per row of cylinders into the outlet duct is fed to the exhaust gas recycling duct and via the exhaust gas recycling duct is recycled to the blowing air manifold and simultaneously, a flow of exhaust gas passing from the outlet duct into the exhaust gas manifold duct to the exhaust gas turbocharger is halted, the exhaust gas recycling rate as a percentage being approximately equal to 100 divided by the number of cylinders per cylinder row, b) approaching full load operation of the internal combustion engine, the control member is positioned in an intermediate position, in which the exhaust gas expelled from the one cylinder of a cylinder row into the outlet duct is split up into a flow part fed to the exhaust gas recycling duct and recycled to the blowing air manifold duct and a flow part entering the blowing air manifold duct and passed to the exhaust gas turbocharger, whereby an exhaust gas recycling rate is produced that is less than in partial load operation.

4. The method as set forth in claim 3, wherein during exhaust gas recycling phases of operation the exhaust gas recycling rate is set between its possible maximum and a minimum to suit the actual load state of the internal combustion engine with optimum compliance with needs by corresponding continuous or discontinuous setting of the control member by the control means.

5. The method as set forth in claim 3, wherein—in the case of application thereof in connection with reciprocating internal combustion engines having two outlet valves for each cylinder in the case of cylinders whose exhaust gas is able to be recycled, each of the two outlet valves is provided with its own outlet duct, of which the one opens directly into the transition zone between the exhaust gas manifold duct and the exhaust gas recycling duct and is formed in the cylinder head separately from the adjacent other one, which again opens into the exhaust gas manifold duct—the exhaust gas expelled into the outlet duct is:

a) during exhaust gas recycling phases of operation, in which the exhaust gas manifold duct is shut off by shut off means preventing flow to the transition zone or, respectively, to the exhaust gas recycling duct, and furthermore the exhaust gas recycling duct is opened for flow by means of a shut off means installed in it and able to be operated by the control means and is switched for full flow, may be completely passed to the blowing air manifold duct, and b) outside the exhaust gas recycling phases of operation on the other hand owing to the shut off means then shifted into the shut off position and of the control member shifted into the position permitting flow, is completely fed to the exhaust gas manifold duct and via the same is fed to the exhaust gas turbocharger.

6. The method as set forth in claims 5, wherein the exhaust gas recycling rate during the exhaust gas recycling phases of operation is also set by a suitable action on the exhaust gas leaving the adjacent outlet duct in such a manner that by means of the control member positioned accordingly by the control member such exhaust gas:

a) in partial load ranges of the internal combustion engine is also completely returned to the exhaust gas recycling duct and via the same to the blowing air manifold duct so that the exhaust gas recycling rate accordingly reaches its maximum which as a percentage, is equal to approximately 100 divided by the number of cylinders per cylinder row, b) approaching the full load range of the internal combustion engine is split up into two flow parts, of which the one is also returned via the exhaust gas recycling duct to the blowing air manifold duct and the other is fed to the exhaust gas manifold duct and thence to the exhaust gas turbocharger so that the exhaust gas recycling rate is smaller than in the part load range.

* * * * *

UNITED STATES PATENT AND TRADEMARK OFFICE

CERTIFICATE OF CORRECTION

PATENT NO. : 6,425,381 B1
DATED : July 30, 2002
INVENTOR(S) : Rammer

It is certified that error appears in the above-identified patent and that said Letters Patent is hereby corrected as shown below:

Title page,
Item [57], should read as follows:

-- [57] ABSTRACT:

A method of recycling exhaust gas of a multi-cylinder reciprocating internal combustion engine with an exhaust gas turbocharger operates without EGR flutter valves and also reduces the amount of designed complexity for the entire EGR design. Exhaust gas recycling is only permitted in the system during certain phases of operation of the internal combustion engine. Only the exhaust gas expelled from one cylinder of a cylinder row is completely or partially recycled at a preset exhaust gas recycling rate via the exhaust gas recycling duct to the blowing air manifold duct, while such exhaust gas recycling is prevented between such exhaust gas recycling phases of operation. The exhaust gas expelled from the cylinder or cylinders is also fed to the exhaust gas turbocharger via the exhaust gas manifold duct. --

Signed and Sealed this

Twenty-ninth Day of October, 2002

*Attest:*

*Attesting Officer*

JAMES E. ROGAN
*Director of the United States Patent and Trademark Office*